US012492654B2

(12) United States Patent
Bock et al.

(10) Patent No.: US 12,492,654 B2
(45) Date of Patent: Dec. 9, 2025

(54) SOUND ABSORBING ELEMENT WITH LOW PROFILE MICRO-LOUVER SLITS AND MUFFLER ASSEMBLY USING THE SAME

(71) Applicant: ACS Industries, Inc., Lincoln, RI (US)

(72) Inventors: Christof Bock, Monterey (MX); Henry C. Howell, III, Oak Creek, WI (US); Stacey L. Smith, Oconomowoc, WI (US)

(73) Assignee: ACS Industries, Inc., Lincoln, RI (US)

( * ) Notice: Subject to any disclaimer, the term of this patent is extended or adjusted under 35 U.S.C. 154(b) by 182 days.

(21) Appl. No.: 18/177,181

(22) Filed: Mar. 2, 2023

(65) Prior Publication Data

US 2023/0279797 A1 Sep. 7, 2023

Related U.S. Application Data

(60) Provisional application No. 63/316,561, filed on Mar. 4, 2022.

(51) Int. Cl.
*F01N 1/24* (2006.01)

(52) U.S. Cl.
CPC ..... *F01N 1/24* (2013.01); *F01N 2470/04* (2013.01); *F01N 2470/24* (2013.01); *F01N 2530/04* (2013.01)

(58) Field of Classification Search
CPC ..... F01N 1/026; F01N 1/24; F01N 2470/04; F01N 2470/24; F01N 2530/04; F01N 1/04
See application file for complete search history.

(56) References Cited

U.S. PATENT DOCUMENTS

| | | | | |
|---|---|---|---|---|
| 963,822 | A | 7/1910 | Smith | |
| 1,536,666 | A | 5/1925 | Franz | |
| 1,949,074 | A * | 2/1934 | Gunn | F01N 1/08 181/249 |
| 2,165,101 | A | 7/1939 | Hudson | |
| 3,545,565 | A | 12/1970 | McCaffrey | |
| 3,710,891 | A | 1/1973 | Flugger | |
| 4,108,275 | A | 8/1978 | Black | |
| 4,325,459 | A * | 4/1982 | Martin | F01N 1/24 181/252 |

(Continued)

FOREIGN PATENT DOCUMENTS

| | | | |
|---|---|---|---|
| DE | 10337110 A1 | 3/2005 | |
| EP | 1507071 A1 * | 2/2005 | F01N 1/003 |

(Continued)

OTHER PUBLICATIONS

English translation of EP-1507071-A1, accessed Feb. 20, 2025 via Espacenet, <https://translationportal.epo.org/emtp/translate/?ACTION=description-retrieval&COUNTRY=EP&ENGINE=google&FORMAT=docdb&KIND=A1&LOCALE=en_EP&NUMBER=1507071&SRCLANG=de&TRGLANG=en> (Year: 2005).*

*Primary Examiner* — Jeremy A Luks
(74) *Attorney, Agent, or Firm* — Hinckley Allen & Snyder; Stephen Holmes

(57) ABSTRACT

A novel sound absorbing sheet material with a unique combination of micro-louver slit parameters and patterns provides superior noise attenuation and a reduced perforation area (less than 3.5%) to better protect fiberglass insulation when used in a muffler assembly. A muffler assembly is disclosed incorporating the novel sound absorbing sheet as the inner exhaust conduit.

22 Claims, 5 Drawing Sheets

(56) References Cited

U.S. PATENT DOCUMENTS

| | | | | |
|---|---|---|---|---|
| 4,338,284 | A * | 7/1982 | Ignoffo | F01N 1/10 422/171 |
| 5,892,186 | A | 4/1999 | Flugger | |
| 6,138,791 | A | 10/2000 | Zanzie | |
| 6,194,052 | B1 | 2/2001 | Knipstein | |
| 6,443,255 | B1 * | 9/2002 | Shavender, Jr. | F01N 13/1822 181/269 |
| 6,555,246 | B1 | 4/2003 | Zwick | |
| 6,679,351 | B2 * | 1/2004 | Cummings | F01N 1/088 181/212 |
| 6,815,044 | B2 | 11/2004 | Boock | |
| 6,857,502 | B2 | 2/2005 | Naito | |
| 7,424,931 | B2 | 9/2008 | Smith | |
| 7,677,359 | B2 | 3/2010 | Vigran | |
| 7,838,125 | B2 | 11/2010 | Pelzer | |
| 10,047,650 | B2 | 8/2018 | Abram | |
| 10,068,563 | B2 | 9/2018 | D'Antonio | |
| 2007/0113540 | A1 * | 5/2007 | Mangold | F01N 13/002 60/282 |
| 2017/0314435 | A1 * | 11/2017 | Panther | F01N 1/083 |
| 2023/0137759 | A1 * | 5/2023 | Baur | F01N 13/1872 |

FOREIGN PATENT DOCUMENTS

| | | | | |
|---|---|---|---|---|
| EP | 1589523 | A2 | 10/2005 | |
| EP | 3242292 | A1 | 11/2017 | |
| JP | 2007005178 | A * | 1/2007 | F01N 1/04 |
| JP | 2009209791 | A * | 9/2009 | |
| WO | 2006101403 | A1 | 9/2006 | |

* cited by examiner

SOUND ABSORBING ELEMENT WITH LOW PROFILE MICRO-LOUVER SLITS AND MUFFLER ASSEMBLY USING THE SAME

CROSS-REFERENCE TO RELATED APPLICATIONS

This application claims the benefit of U.S. Provisional Patent Application No. 63/316,561, filed Mar. 4, 2022, the entire contents of which is incorporated herein by reference.

BACKGROUND OF THE DISCLOSURE

The present disclosure relates generally to sound absorbing elements and more particularly to a sound absorbing panel or tube structure having micro-louver sound attenuating slits which can be used to attenuate noise in various environments, and in particular, exhaust noise in muffler assemblies.

Slotted or perforated sheet materials are known for use in attenuating sound in various industries and environments, such as acoustic enclosures for machinery, etc., and in connection with the present disclosure, in attenuating exhaust noise in mufflers.

In enclosure structures, the sheet materials may be utilized as flat sheets lining the interior of an enclosure.

In connection with an exhaust environment, the slotted or perforated sheets are rolled into a tube and may be used as an inner exhaust conduit within a muffler structure. A concentric outer tube enclosure may be provided in spaced relation to the inner tube, and one or more layers of fiberglass insulation may be layered between the inner tube and the outer tube to form the basic muffler structure.

Previous sound absorbing elements have attempted to balance material composition, material weight, thickness, perforation/slit size (width, length, height), density, perforation/slit pattern and perforation percentage (i.e. the ratio of open to closed area per square unit of measure) in order to maximize performance and utility. Generally, it has been thought that increasing the perforation percentage, i.e. providing a larger open area per square inch, would improve sound attenuation, but performance has not been significantly improved over the years. Additionally, a known drawback to increasing the perforation ratio is that it exposes the surrounding fiberglass insulation to excessive heat and exhaust gas chemistry which degrades the fiberglass insulation, allows fiberglass particles to leak into the exhaust stream and ultimately allows the particles to be expelled into the environment.

There is therefore believed to be a need for an improved sound attenuating material which both maintains or improves sound attenuation as well as protecting the fiberglass insulation from heat and gas and acting to retain the fiberglass material within the muffler.

SUMMARY OF THE DISCLOSURE

The present invention provides a novel sound absorbing sheet material with a unique combination of micro-louver slit parameters and patterns which provide both superior noise attenuation and a reduced perforation area to better protect fiberglass insulation when used in a muffler assembly.

The present invention further provides a novel muffler assembly incorporating the novel sound absorbing sheet as the inner exhaust conduit.

BRIEF DESCRIPTION OF THE DRAWING FIGURES

Exemplary embodiments will now be described further by way of example with reference to the following examples and figures, which are intended to be illustrative only and in no way limiting upon the scope of the disclosure.

DETAILED DESCRIPTION OF THE EXEMPLARY EMBODIMENTS

Certain exemplary embodiments will now be described to provide an overall understanding of the principles of the structure, function, manufacture, and use of the device and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present disclosure. Further, in the present disclosure, like-numbered components of the embodiments generally have similar features, and thus within a particular embodiment each feature of each like-numbered component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Further, to the extent that directional terms like top, bottom, up, or down are used, they are not intended to limit the systems, devices, and methods disclosed herein. A person skilled in the art will recognize that these terms are merely relative to the system and device being discussed and are not universal.

Figure 1:
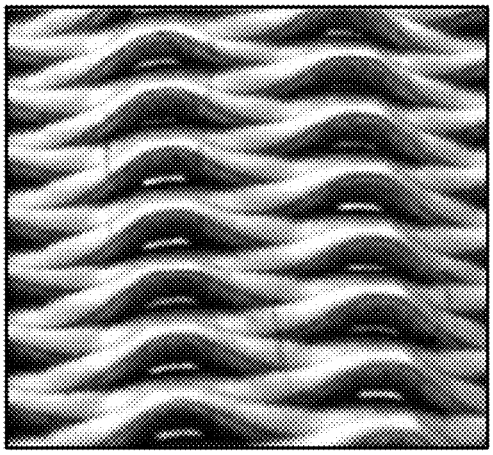
FIG. 1 PRIOR ART
FIG. 1A illustrates a prior art sheet material formed from a thick material having deep perforated slits.
FIG. 1B illustrates an exemplary novel sheet material formed from a thin stainless-steel material and having shallow micro-louver slits formed in accordance with the teachings of the present invention.
FIG. 1C illustrates the novel sheet material of FIG. 1B flattened to reduce the height profile of the micro-louvers.
Figure 1B:
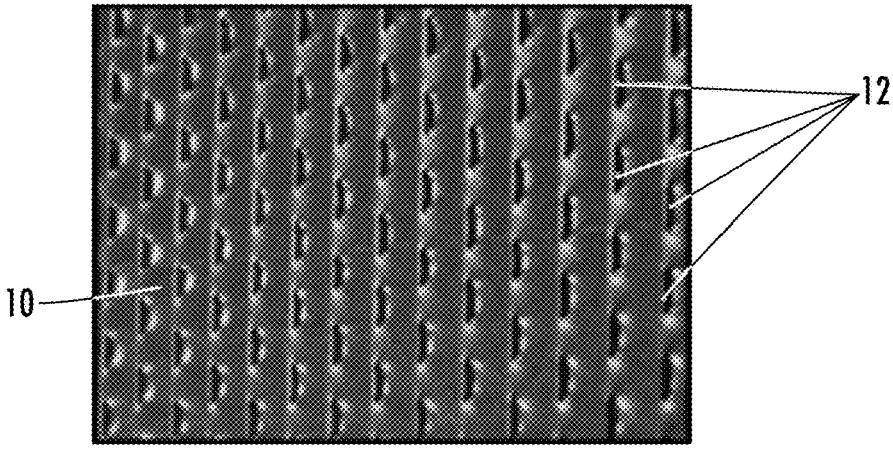
Figure 1C:
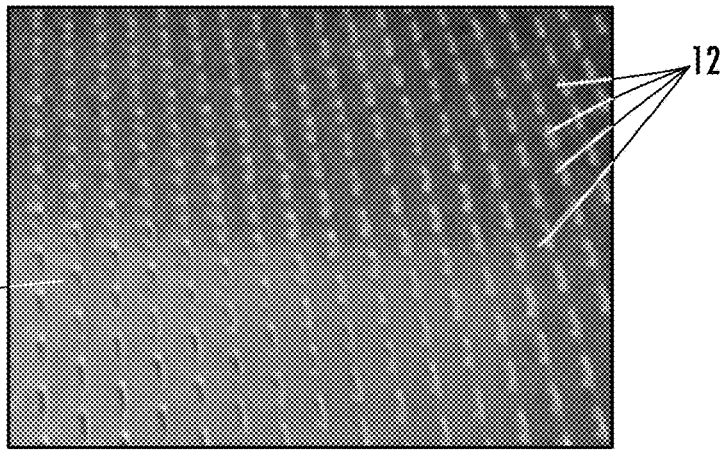
Figure 2A:
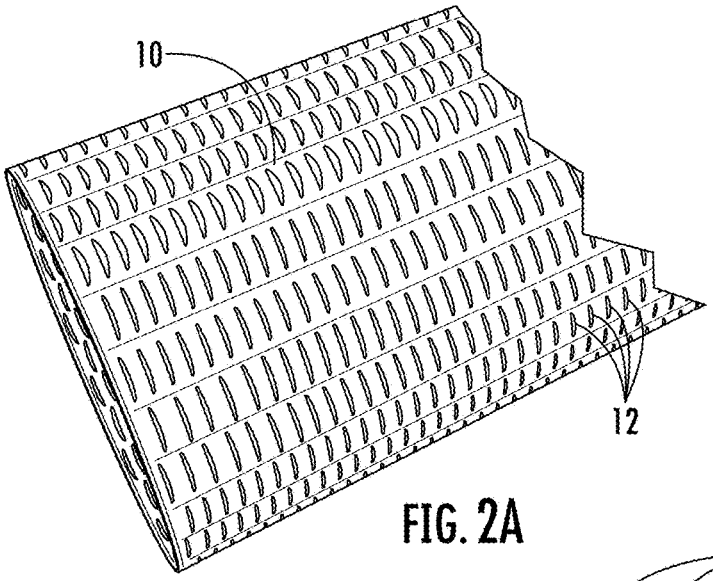
FIG. 2A is a perspective view of an exemplary micro-louver sheet material rolled and welded longitudinally into a cylinder for use in a muffler.
Figure 2B:
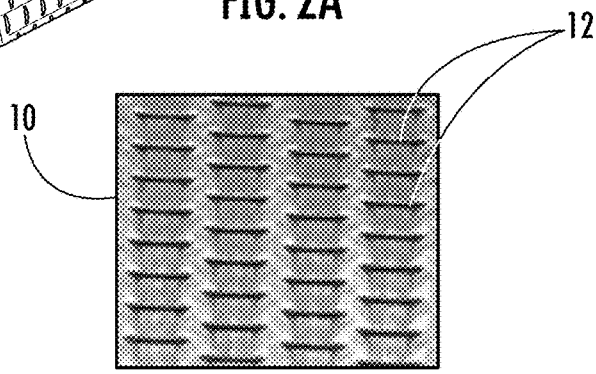
FIG. 2B is an enlarged view of an exemplary row of slits.

Referring to FIGS. 1B and 1C, the present disclosure generally provides a novel sound absorbing sheet material 10 having a plurality of micro-louvered slits 12 with a unique combination of dimensional parameters and patterns which provide both superior noise attenuation across multiple possible environments as well as a reduced perforation area (open area) to better protect surrounding fiberglass insulation from heat and exhaust gas chemistry when used in a muffler assembly.

The materials from which the sound absorbing sheets 10 may be manufactured are preferably metals. Examples may include stainless-steel, stainless-steel alloys, aluminum, aluminum alloys, aluminized steel, austenitic alloys and ferritic alloys, as well as other metals and metal alloys.

In an exemplary embodiment, the sheet material may comprise 0.012 inch (0.3048 mm) thick Annealed Ferritic Stainless Steel. This is roughly half the thickness of previous sheet materials. The thinner sheet material is lower in weight and cost and allows a shallower perforation depth to pierce the material. This in turn allows easier manufacturing, consumes less energy during the manufacturing process and provides a lower micro-louver height (h) perpendicular to the material plane. The lower profile micro-louvers also improve (reduces) turbulence within the exhaust gas flow over the surface thereof.

The thinner metal material is also easier to handle and roll into tubular form or other forms and is also easier to weld.

Figure 3:
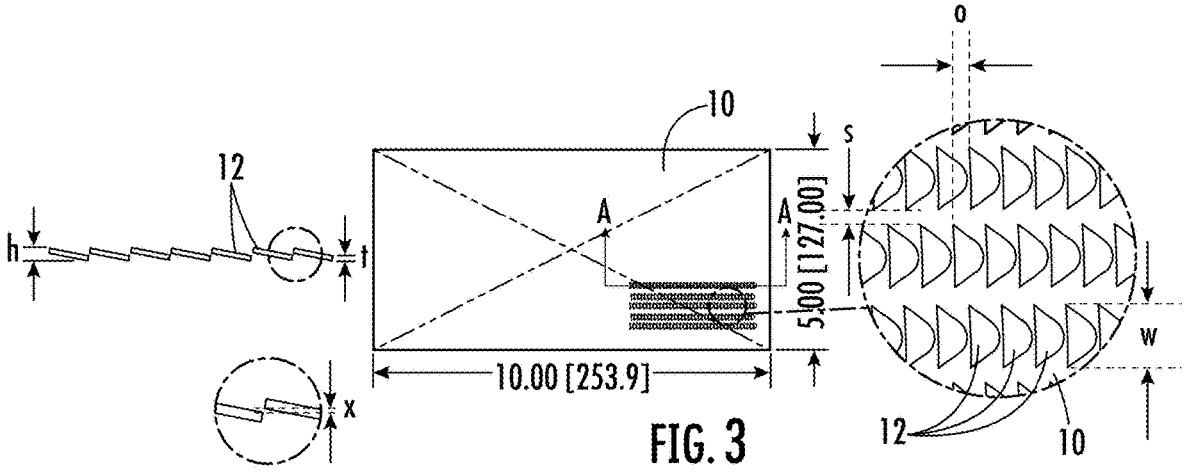
FIG. 3 illustrates various features of an exemplary sound absorbing sheet including a micro-louver in-line longitudinal slit pattern formed in accordance with the teaching of the present invention.

Furthermore, the thinner material allows the micro-louver openings 12 to be formed with the same total cross-sectional perforation area but having a smaller louver height (h) and a smaller cross-sectional slit height (x) (see Prior Art FIG. 1A vs. FIGS. 1B and 1C) (See also FIG. 3). These parameters may help retain fiberglass material particles within a muffler structure.

FIGS. 2A, 2B, 3 and 4 illustrate an exemplary embodiment of a sound absorbing element 10 (muffler tube blank) with a plurality of micro-louver slits 12 formed in a longitudinal in-line pattern.

The micro-louver slits 12 in the illustrated embodiments may be accomplished with suitable shearing pressure perpendicular to the material plane whereby the louver edge is partly pressed out of the plane and the slit created with a shallow height (FIG. 1B).

As previously seen in FIG. 1C, the blank sheet 10 is flattened after formation of the slits 12 to reduce the slit height while retaining the perforation ratio.

Referring to FIG. 3 there is shown schematically Section A-A where it can be seen that the micro-louvers 12 are oriented perpendicular to the material plane. In the shearing operation to make the slit, the shear surface is pressed out more than the thickness of the material plane.

FIG. 3 further includes magnifications where the louvers 12 can be seen in more detail. The width "w" and height "h" of the louvers have been marked in the enlarged figure. The cross-sectional height "x" of the slit opening is also marked.

As noted above, the relationship between the slits is largely dependent on how large a percentage of the surface the slits form, i.e. the perforation ratio or open area percentage. In this regard, the Applicant has found through extensive testing that with the above noted dimensional parameters, the perforation ratio "P" can be much lower than found in the prior art, and in this regard can be lower than 3.5% open area, and more preferably can be about 2% open area.

In this regard, the ranges of these dimensional parameters are laid out in the table below. The identified parameters are meant to serve as guidelines and the invention should not be limited by these exemplary ranges.

| Parameter | Range | Exemplary Value |
|---|---|---|
| Thickness "t" | 0.2-0.5 mm | 0.3 mm |
| Width "w" | 1-3 mm | 1.5 mm |
| Spacing "s" | 0-0.6 mm | 0.2 mm |
| Offset "o" | 0.5-1.5 mm | 0.9 mm |
| Overlap "L" | 0.3-0.6 mm | 0.5 mm |
| Louver Height "h" | 0.30-0.45 mm | 0.33 mm |
| Slit height "x" | 0.03-.120 mm | 0.08 mm |
| Perforation ratio "P" | $1\% \geq P \leq 3.5\%$ | 2% |

Figure 5:
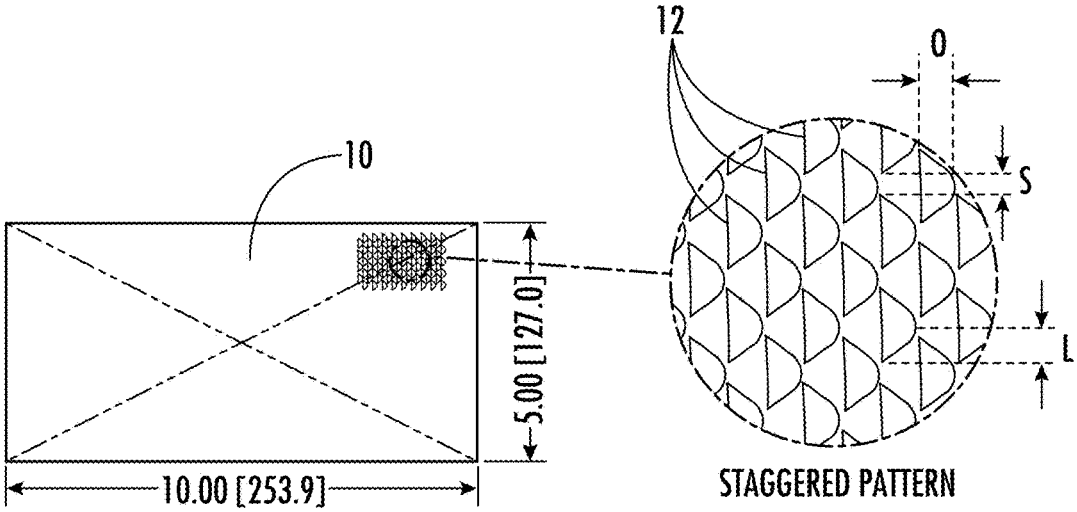
FIG. 5 illustrates a staggered micro-louver pattern.
Figure 6:
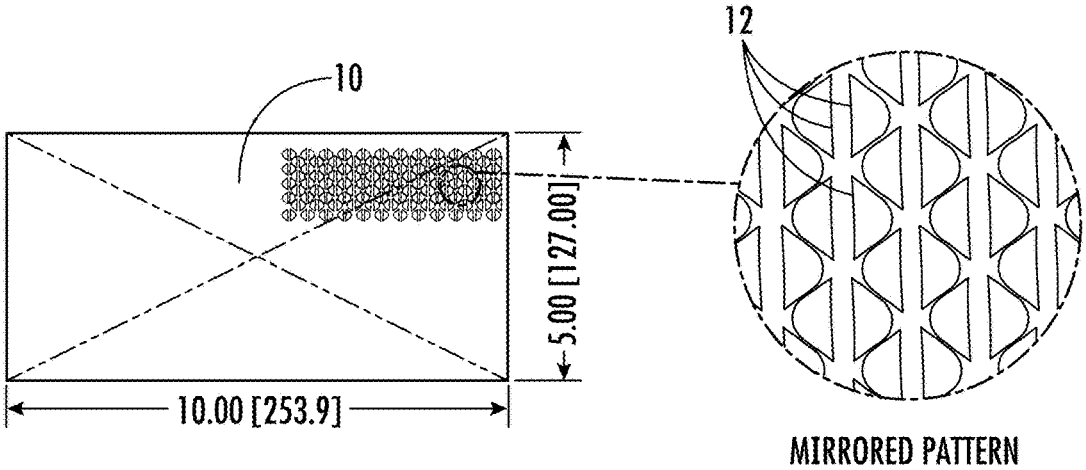
FIG. 6 illustrates a mirror micro-louver pattern.
Figure 7:
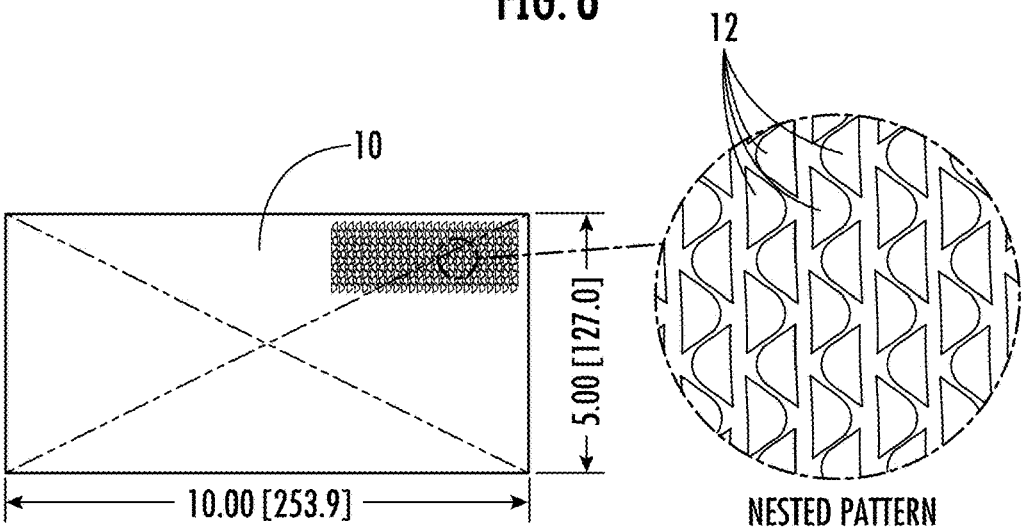
FIG. 7 illustrates a nested micro-louver pattern.

The pattern formed by the slits 12 constitutes just one example of a variety of possible placements and orientations of the slits and in this regard, FIGS. 5-7 illustrate at least three additional exemplary micro-louver slit patterns which are contemplated within the scope of the invention.

FIG. 5 illustrates a staggered micro-louver pattern. The slits 12 on the staggered pattern as shown in FIG. 3 are located in longitudinal rows, which are spaced "s" and slightly offset "o" perpendicular to the longitudinal axis. Spacing and offset parameters are found in the table above.

FIG. 6 illustrates a mirror micro-louver pattern.

FIG. 7 illustrates a nested micro-louver pattern.

Each of the noted louver patterns in FIGS. 3-7 have a perforation ratio (P) of about 2% with a range of greater than or equal to 1% and less than or equal to 3.5%.

Figure 4:
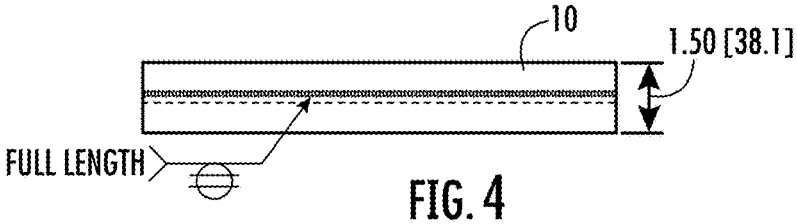
FIG. 4 is a plan view of the sheet rolled and welded longitudinally into a cylindrical tube for use in an exemplary muffler.
Figure 8:
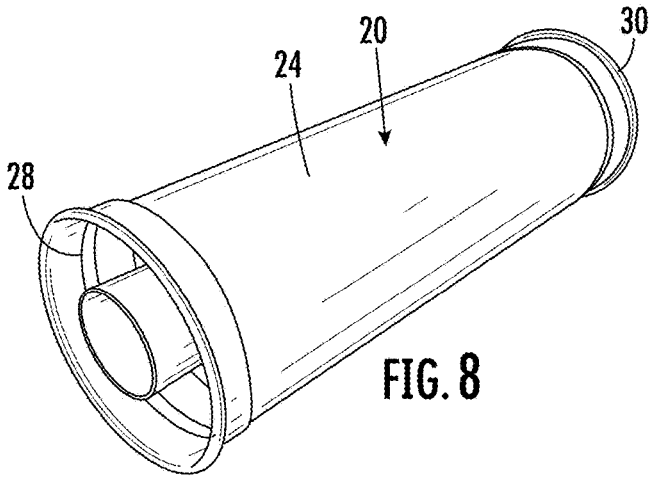
FIG. 8 is a perspective view of an exemplary muffler assembly incorporating the novel sound absorbing sheet material of the present invention.
Figure 9:
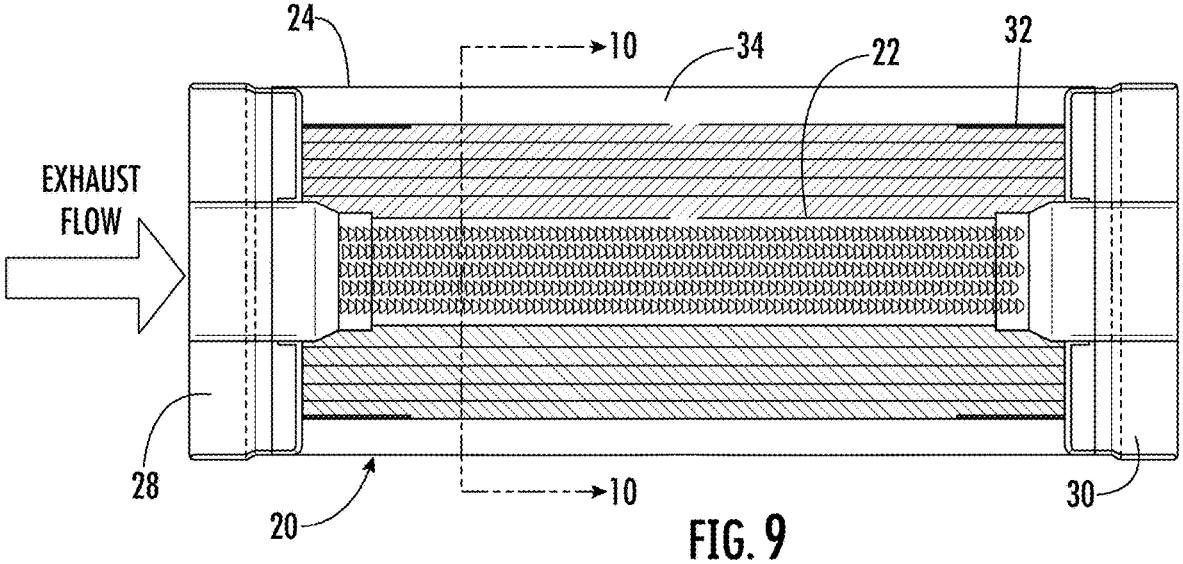
FIG. 9 is a cross-sectional view thereof taken along line 9-9 of FIG. 8.
Figure 10:
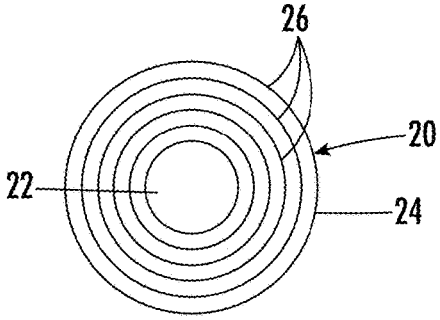
FIG. 10 is a cross-sectional view thereof taken along line 10-10 of FIG. 9.

Turning now to FIGS. 8-10, an exemplary muffler assembly 20 is illustrated including a sheet of micro-louver material 10 rolled into tubular form in accordance with the teaching described hereinabove. While the in-line micro-louver pattern of FIGS. 2-4 is illustrated in the present muffler example, it has been found that the staggered pattern as shown in FIG. 5 offers the best sound attenuation of the 4 different patterns.

Generally, the muffler assembly 20 comprises an inner micro-louver sheet tube 22 (as described above) rolled with the perforations 12 extending from inside to outside and welded longitudinally in a cylindrical configuration (see also FIG. 4), a concentrical outer tube housing 24, and a plurality of concentric layers of fiberglass insulation 26 disposed between the outside surface of the inner tube 22 and the inside surface of the outer tube 24. The fiberglass insulation 26 may in some embodiments comprise 5 concentric wraps of E-Glass Fiber insulation. Fewer or more insulating layers may be utilized depending on the muffler diameter and other performance requirements. Opposing annular end caps 28, 30 capture the inner and outer tubes 22, 24 and the fiberglass insulating layer 26 in concentric relation and form the input and output ends of the muffler assembly with exhaust gas flow being directed axially through the inner tube 22.

The outer tube 24 may include an inner annular flange 32 to create an annular gap 34 between the outer surface of the outer fiberglass layers 26 and the inner surface of the outer tube housing 24.

Figure 11:
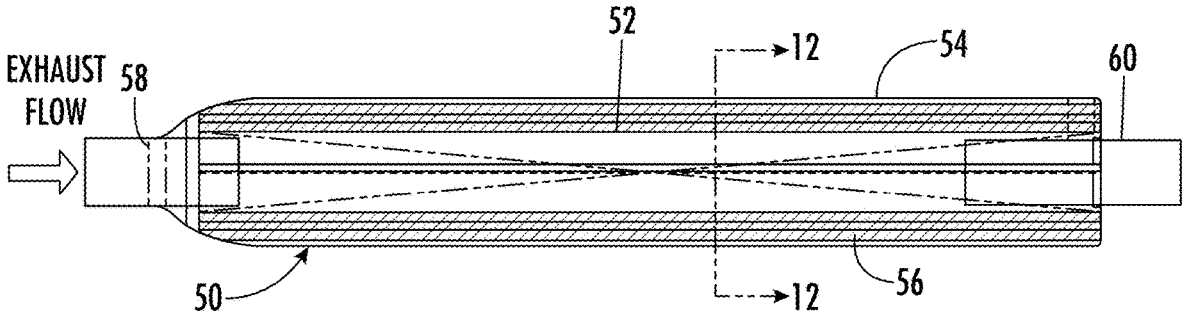
FIG. 11 illustrates a cross-sectional view of another exemplary muffler assembly incorporating a novel sound absorbing sheet material of the present invention.
Figure 12:
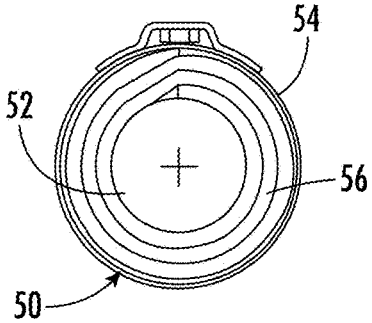
FIG. 12 is a cross-sectional view thereof taken along line 12-12 of FIG. 11.

A further muffler assembly 50 is illustrated in FIGS. 11 and 12, using the staggered louver pattern as shown in FIG. 5. Generally, the muffler construction 50 comprises an inner micro-louver sheet tube 52 (as described above) rolled with the perforations 12 direction extending from inside to outside and welded longitudinally in a cylindrical configuration, a concentrical outer tube housing 54, and a plurality of concentric layers of fiberglass insulation 56 disposed between the outside surface of the inner tube 52 and the inside surface of the outer tube 54. The fiberglass insulation 56 may in some embodiments comprise a continuous concentric wrap of E-Glass Fiber insulation forming three insulating layers. Fewer or more insulating layers may be utilized depending on the muffler diameter and other performance requirements. Opposing end caps 58, 60 capture the inner and outer tubes in concentric relation and form the input and output ends of the muffler assembly with exhaust gas flow being directed axially through the inner tube 52.

While the exemplary muffler embodiments are illustrated with round tubular exhaust tubes, some exemplary muffler embodiments may use alternative non-round shapes for the exhaust gas flow. Examples may include oval tubular, elliptical tubular, square tubular or rectangular tubular shapes. Generally, it should be understood that the micro-louver blank material can be formed into any desired shape which is appropriate for the end use and air flow pattern in any application.

It can therefore be seen that the exemplary embodiments described herein provide unique and novel sound absorbing structure having micro-louver sound attenuating slits which can be used to attenuate exhaust noise in muffler assemblies. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A sound absorbing element comprising:

a metal sheet having a thickness (t) greater than or equal to 0.2 mm and less than or equal to 0.4 mm, said metal sheet having a plurality of louvered slits formed in a predetermined longitudinally extending pattern, wherein each of said plurality of louvered slits has a width (w) greater than or equal to 1 mm and less than or equal to 3 mm, a louver height (h) greater than or equal to 0.35 mm and less than or equal to 0.45 mm, and a slit height (x) greater than or equal to 0.03 mm and less than or equal to 0.120 mm, wherein the metal sheet has a perforation ratio (P) greater than or equal to 1% and less than or equal to 3.5%, wherein said metal sheet comprises a tube having an inner conduit through which an airflow passes from a first end to a second end; and at least one layer of fiber insulation extending around said outside of said sheet metal tube, said slit height and width, said louver height and said perforation ratio being configured to allow acoustic waves through the louvered slits for sound attenuation yet also retain fibers from said fiber insulation from entering the airflow within the inner conduit.

2. The sound absorbing element of claim 1 wherein the metal sheet is selected from the group consisting of stainless-steel, stainless-steel alloys, aluminum, aluminum alloys, aluminized steel, ferritic alloys, and austenitic alloys.

3. The sound absorbing element of claim 2 wherein the metal sheet is stainless steel and has a thickness (t) between 0.25 mm and 0.35 mm.

4. The sound absorbing element of claim 1 wherein said louvered slits are in an in-line pattern.

5. The sound absorbing element of claim 1 wherein said louvered slits are in a staggered pattern.

6. The sound absorbing element of claim 1 wherein rows of said louvered slits have an offset (o) of greater than or equal to 0.5 mm and less than or equal to 1.5 mm and a spacing(s) of greater than or equal to 0 and less than or equal to 0.6 mm.

7. The sound absorbing element of claim 3 wherein said louvered slits are in a staggered pattern.

8. The sound absorbing element of claim 7 wherein rows of said louvered slits have an offset (o) of greater than or equal to 0.5 mm and less than or equal to 1.5 mm and a spacing(s) of greater than or equal to 0 and less than or equal to 0.6 mm.

9. The sound absorbing element of claim 1 wherein said louvered slits are in a mirror pattern.

10. The sound absorbing element of claim 1 wherein said louvered slits are in a nested pattern.

11. A muffler assembly comprising:

a sound attenuating inner tube;

an outer concentric housing tube;

opposing end caps configured to capture the inner and outer tubes in concentric relation and form input and output ends for exhaust gases; and at least one layer of fiber insulation disposed between the inner tube and the outer tube, wherein the sound attenuating inner tube comprises, a metal sheet having a thickness (t) greater than or equal to 0.2 mm and less than or equal to 0.4 mm, said metal sheet having a plurality of louvered slits formed in a predetermined longitudinally extending pattern, wherein each of said plurality of louvered slits has a width (w) greater than or equal to 1 mm and less than or equal to 3 mm, a louver height (h) greater than or equal to 0.35 mm and less than or equal to 0.45 mm, and a slit height (x) greater than or equal to 0.03 mm and less than or equal to 0.120 mm, wherein the metal sheet has a perforation ratio (P) greater than or equal to 1% and less than or equal to 3.5%, said slit height and width, said louver height and said perforation ratio being configured to allow acoustic waves through the louvered slits for sound attenuation yet also retain fibers from said fiber insulation from entering the airflow within the inner conduit.

12. The muffler assembly of claim 11 wherein the metal sheet is selected from the group consisting of stainless-steel, stainless-steel alloys, aluminum, aluminum alloys, aluminized steel, ferritic alloys, and austenitic alloys.

13. The muffler assembly of claim 12 wherein the metal sheet is stainless steel and has a thickness (t) between 0.25 mm and 0.35 mm.

14. The muffler assembly of claim 11 wherein said louvered slits are in an in-line pattern.

15. The muffler assembly of claim 11 wherein said louvered slits are in a staggered pattern.

16. The muffler assembly of claim 15 wherein rows of said louvered slits have an offset (o) of greater than or equal to 0.5 mm and less than or equal to 1.5 mm and a spacing(s) of greater than or equal to 0 and less than or equal to 0.6 mm.

17. The muffler assembly of claim 13 wherein said louvered slits are in a staggered pattern.

18. The muffler assembly of claim 17 wherein rows of said louvered slits have an offset (o) of greater than or equal to 0.5 mm and less than or equal to 1.5 mm and a spacing(s) of greater than or equal to 0 and less than or equal to 0.6 mm.

19. The muffler assembly of claim 11 wherein said louvered slits are in a mirror pattern.

20. The muffler assembly of claim 11 wherein said louvered slits are in a nested pattern.

21. The sound absorbing element of claim 1, wherein said fiber insulation comprises fiberglass insulation.

22. The muffler assembly of claim 11, wherein said fiber insulation comprises fiberglass insulation.

* * * * *